United States Patent [19]

Lorenz et al.

[11] 4,134,794

[45] Jan. 16, 1979

[54] METHOD FOR PRODUCING NON-ABRASIVE COKE FORMS FROM BROWN-COAL BRIQUETS

[75] Inventors: Kurt Lorenz, Hattingen; Horst Dungs, Herne; Peter Speich, Cologne, all of Fed. Rep. of Germany

[73] Assignees: Firma Carl Still; Rheinische Braunkohlenwerke Aktiengesellschaft, both of Fed. Rep. of Germany

[21] Appl. No.: 837,448

[22] Filed: Sep. 28, 1977

Related U.S. Application Data

[63] Continuation of Ser. No. 660,153, Feb. 23, 1976, abandoned.

[51] Int. Cl.[2] ..... C10B 17/00; C10B 21/02; C10B 21/12; C10B 53/08

[52] U.S. Cl. ..... 201/27; 201/29; 201/34; 201/35; 201/37; 201/39; 201/43; 201/44

[58] Field of Search ..... 201/9, 15, 27, 29, 34, 201/35, 37, 39, 43, 44; 202/121, 127, 114, 99, 108, 109

[56] References Cited

U.S. PATENT DOCUMENTS

| | | | |
|---|---|---|---|
| 1,563,271 | 11/1925 | Fogh | 201/29 |
| 1,901,169 | 3/1933 | Karrick | 202/99 |
| 1,907,569 | 5/1933 | Parr et al. | 202/99 |
| 2,131,702 | 9/1938 | Berry | 201/15 |
| 2,448,223 | 8/1948 | Lantz | 201/27 |
| 3,018,227 | 1/1962 | Baum | 201/9 |
| 3,172,823 | 3/1965 | [illegible] | |
| 3,177,1[illegible] | | | |
| 3,316, | | | |
| 3,705, | | | |
| 4,007, | | | |
| 4,050, | | | |

FOREIGN PATENT DOCUMENTS

| | | |
|---|---|---|
| 530983 | 7/1931 | Fed. Rep. of Germany. |
| 882392 | 7/1953 | Fed. Rep. of Germany. |
| 49314 | 8/1966 | German Democratic Rep. |
| 947726 | 1/1964 | United Kingdom. |

*Primary Examiner*—Morris O. Wolk
*Assistant Examiner*—Bradley Garris
*Attorney, Agent, or Firm*—McGlew and Tuttle

[57] ABSTRACT

The coke forms are produced in four stages, each constituted by a respective oven chamber, and in which the briquets are, respectively, preheated, dehydrated or dried, carbonized and cooled. Hot gas circuits are provided, in which the hot gas is composed substantially of burnt lean gas of the carbonization, and, for each stage, the hot gases are recirculated in a separate respective circuit. In the preheating, dehydrating and carbonization stages, the hot gases are heated and produced, or supplemented, in a respective separate combustion chamber with the recirculating hot gas in the carbonization stage being supplemented with cooled lean gas from this stage. The recirculating hot gases are dedusted separately in a dust settling chamber in which their flow velocity is reduced to approximately 0.2 to 2.0 m/sec, with the dust being collected. Steam may be added to the recirculating hot gas of the preheating stage, drying stage, or both, and the pressure in the hot gas circuits is maintained at a level slightly higher than atmospheric pressure. The oven chambers are arranged as a vertical oven block plant and the oven chambers are interconnected with each other by transition zones which are conically narrowed to approximately one half of the cross section of the chamber and then widened up to the full cross section. The hot gas inlets are provided in the transition zones at the lower ends of the oven chambers, and the hot gas outlets are provided in the transition zones at the upper ends of the chambers. The dust settling chambers are provided immediately [illegible] to

FIG. 1

METHOD FOR PRODUCING NON-ABRASIVE COKE FORMS FROM BROWN-COAL BRIQUETS sp

CROSS-REFERENCE TO RELATED APPLICATIONS

This is a continuation of application Ser. No. 660,153, filed Feb. 23, 1976, now abandoned.

The apparatus for performing the method of this invention forms the claimed subject matter of divisional application Ser. No. 833,645, filed Sept. 15, 1977, which is a continuation of application Ser. No. 706,542, filed July 19, 1976, now abandoned, which is a division of application Ser. No. 660,153, now abandoned.

FIELD AND BACKGROUND OF THE INVENTION

The present invention relates to a method of producing non-abrasive coke forms from brown-coal briquets, according to which the briquets are preheated, dehydrated, carbonized and subsequently cooled, with the entire operation being effected in at least three stages and with the use of hot gas circuits in which the hot gas is composed substantially of the burnt lean gas of the carbonization or low temperature carbonization process.

Such method is well known in the art. Frequently the individual stages are united or merged into one another. While a complete separation of the individual stages is technically very difficult to achieve, in view of a better utilization of the circulating hot gases, a complete separation of the hot gas circuits would be desirable. The technology also seeks to increase the mechanical resistance of the produced coke forms. Particular difficulties result from the fact that, in their circulation, the hot gases carry along large quantities of coal dust originating in the abrasion of the briquets and, at the same time, containing oil and tar components. This entails particular problems of condensation which, up to date, have not been solved in the art in a satisfactory manner. In this respect again, an increased mechanical resistance of the briquets to be coked is desirable.

German Pat. No. 530,983 describes a process where pressure-resistant solid coke is obtained from lignites and the like by a two-stage distillation, and where the material traversing the oven in counter flow is evened by scavenging gases and brought, in the second stage, abruptly from about 450° C. to about 700°-1,000° C.

German Pat. No. 882,392 describes a process for the continuous distillation of hard coal briquettes and a low-temperature carbonization or a high-temperature coking stage with exclusive heating of both stages by directly acting heated gases, where the distillation gases produced separately in each stage are kept in circulation by constant reheating. However, this patent contains no information on the production of the briquettes, particularly on whether caking coal or non-caking coal was used.

British Pat. No. 947,726 describes a counter flow method for coking lumpy Australian brown coal to lumped coke, where thecoal is preheated in a drying and preheating zone to about 200°-300° C. and fed to a low-temperature coking zone heated with hot gases in which each following stage has a higher temperature than the preceding stage, and the maximum temperature difference between the gas and the material to be coked does not exceed 150° C. at the outlet of the stage, and is then completely coked in a high temperature zone.

U.S. Pat. No. 3,018,227 concerns a process where briquettes, compressed from special coal mixtures and with the addition of pitch, are coked to shaped coke pieces, and the briquettes are subjected to a temperature shock with their surfaces being heated spontaneously to 532°-677° C.

Berry U.S. Pat. No. 2,131,702 describes a process for continuous coking, where coal briquettes from caking coal are heated to such an extent in a first zone that degasificatio starts, and heated in a second zone from the softening temperature to 500°-600° C., and then heated in a third zone to 700°-1,000° C.

These known methods can be used for coking lumped coal of a certain type and for briquettes which were produced from a certain type of coal and in a certain manner. However, a general solution of the problem of coking briquettes from brown coal with lower coking qualities, particularly from non-caking brown coal, has not yet been suggested.

Since workable deposits of caking brown coal, which imparts good coking property to the briquettes produced therefrom, and from which shaped coke pieces of sufficient strength and hardness for metallurgical use have become rare, the industry still faces the problem of briquetting brown coals with lower coking qualities, that is, non-caking brown coals, and of producing coke therefrom. The solution of this problem is aggravated by the fact that these coals must be briquetted, in most cases for economical reasons, without the addition of binders.

The condensation and scrubbing of oil and tar components out from the dust-laden gases leads to the necessity of removing the washing lquids, which are loaded with coal dust, from the scrubbing circuit, since their viscosity becomes excessive and they can no longer be pumped. The further processing of such mixtures is expensive wherefore a better dust separation from the circulating gases would represent a technological progress, all the more as the dust entrained by the circulating gases causes clogging in almost all parts of the equipment, and which can be cleared only by troublesome manual work.

In known methods, temperatures of 110° C. to 135° C. for the preheating, 230° C. to 330° C. for the drying and 550° C. to 650° C. for the coking are used.

It is also known to use the lean gas, produced during the carbonization, for preheating and drying and as the drying gas for preheating and subsequently, to evacuate the gases into the free atmosphere. It is also known to separate the individual stages by means of mechanical members, such as lids. However, this measure frequently entails disturbances in the plant.

SUMMARY OF THE INVENTION

The invention is therefore based on the problem of providing a new coking method for lignite briquettes which are produced from non-caking lignites or brown coal, and for producing these briquettes without the addition of binders.

The present invention is directed to a method permitting a satisfactory separation of dust from the hot gases in circulation so that the condensation is not disturbed and clogging is eliminated, and, at the same time, ensuring a thorough carbonization resulting in non-abrasive coke forms which are stable in shape.

In accordance with the invention, a method of the kind mentioned in the beginning is provided in which, in each stage, the hot gases are recirculated in a separate circuit. This measure alone already makes it possible to optimize quite substantially the temperature-time curve of the coking process, which is determinative for the mechanical resistance of the coke forms.

In this connection, it has been found advantageous to carry out the process in separate stages in which the brown-coal briquets are preheated, dehydrated, or dried, carbonized and cooled, respectively.

A further advantage has been found in that the hot gases recirculating in the preheating, dehydrating and carbonization stages are each produced, supplemented and heated in a separate combustion chamber.

It is a particular advantage, for the strengths of the shaped coke pieces, if cooled lean gas from the coking or carbonization stage is added to the gas circuit before it re-enters the coking or carbonization stage.

In accordance with a particular development of the invention, the hot gas of each of the circuits is dedusted separately, immediately after the gas has left the stage and before it has been substantially cooled down. In the dust settling chambers, the gas has a velocity of 0.2 to 2.0 m/sec, depending on what degree of dust separation is desired. Such removal of dust from circulating gases by reducing the velocity is known from German Pat. No. 882,392 and Berry U.S. Pat. No. 2,131,702 and, with this procedure, a considerable reduction of the accumulation of dust in the circulating gases is achieved. This has the result that the removal of dust and the cleaning of the condensation system, respectively, are necessary only at large time intervals.

In a preferred variant of the inventive method, (a) the preheating is effected up to a temperature of 120° C., while using 1.5 to 2.5 $Nm^3/h$ of hot gas per 1 kg of brown-coal briquets; (b) the dehydration is effected at 210° C. to 250° C., while using 5 to 6 $Nm^3/h$ of hot gas per 1 kg of brown-coal briquets; (c) the carbonization is effected at 800° C. to 900° C., while using 1.5 to 2.5 $Nm^3/h$ of hot gas per 1 kg of brown-coal briquets, the hot gases being heated in the combustion chamber to a temperature of 1000° C. to 1400° C. and lean gas, coming from the carbonization stage and cooled down to 25° C. to 35° C., is admixed thereto.

For obtaining coke forms having a satisfactory mechanical resistance, the control of the preheating and drying of the brown-coal briquets or forms is of great importance. The control of the ratio of the fresh gas to the recirculating gas in the different hot gas circuits is a means for adjusting any water vapor content in the preheating and drying stages and, thereby, for adjusting any preheating and drying velocity as well as any temperature gradient from the surface to the core of the forms.

It is true that, in most cases, the water vapor concentration in the hot gas circuits of the preheating and drying stages is satisfactory already due to the use of only recycle gas for adjusting a low temperature gradient in the forms. However, from time to time, the addition of steam may also prove advantageous.

During the preheating, the brown-coal forms expand and, during the drying phase, they start shrinking, due to the loss of water. To prevent crack formation during this process, the transition from the expansion to the shrinkage must be extremely smooth, wherefore the temperature gradient in the forms during this heating phase is to be kept as low as possible.

Experience has shown that this requirement is met more satisfactorily if additional steam is supplied into the hot gas circuit of the preheating stage and/or the drying stage. Thereby, due to the high water vapor concentration in the gas circuits, the escape of water vapor from the surface of the forms is retarded and a gentle treatment of the briquets is obtained. Thus all means are now available for adjusting any degree of humidity of the preheating and drying gases and, consequently, for controlling the preheating and drying velocity.

An essential for the present invention is the uncoupling of the preheating stage and the dehydration or drying stage, which has not been done before. With such uncoupling, a great flexibility of the process is attained, and the independent control of temperature and water content in the circuits permits the adaptation of the process to lignite briquettes from any lignite or bown coal with low coking qualities. It has also been found that the reason for the equality of the resulting shaped coke pieces resides in the first two stages, that is, the preheating stage and the dehydration or drying stage, using the measures embodied by the present invention, and a combination of these two stages is possible only with lignite or brown coal briquettes with good coking qualities.

In the method, in accordance with the invention, the shaped coke pieces do not receive their unexpected great strength by a melting bond, since the lignite or brown coal briquettes contain no fluxes. It must therefore be assumed that the firm bond is caused by homogeneous shrinkage of the briquettes over their entire volume, that is, with the measures of the present invention, it is possible to effect the heating of the briquettes or shaped pieces at such a rate that substantial structural tensions and excess pressures can be avoided, at any time, in the pores, and furthermore a substantially synchronous explosion of the volatile components and of the shrinkage is obtained, that is, the weight of the volatile components expelled corresponds at any time to the volume of the shrinkage. Thus, substantial changes in the apparent density of the shaped pieces are avoided. The initial temperature gradient between the surface of the shaped pieces and the gas from the coking stage is of minor importance, because experience has shown that gases of over 1,000° C. can be used in the coking or carbonization stage, while, in known processes, only gases of not more than 1,000° C. can be used.

Gasification of the coal is effectively avoided by returning the cooled coke oven gases into the coking or carbonization stage. Presumably, this is due to the fact that the supply of gasing agents, particularly steam, is limited by the resulting ratio of return gas to fresh gas.

Another advantage of the method embodying the invention is that the coke oven gas of the coking or carbonization stage is not diluted by the gases of the other circuits, due to the separation of the gas circuits, so that it does not loose its heating power. It can therefore be used for its own heating in the method. Its volume also remains within limits, so that only gas purifying apparatus of corresponding small dimensions is required.

The complete separation of the gas circuits of each stage, except for their connection to a supply of lean gas, provides a further possibility of varying the conditions for preheating, drying and coking or carbonization, and this complete separation is responsible for the flexibility of the method of the invention.

Advantageously, the process is conducted at a pressure which is slightly higher than the atmospheric pressure. In this manner, the intrusion of air oxygen is prevented.

An oven particularly suitable for carrying out the inventive method comprises four oven chambers arranged one above the other, for preheating, dehydrating, carbonization and cooling, respectively, which are partly lined with a refractory material and which, in the transition zone from one chamber to the next one, are conically narrowed down to approximately one half of the cross section of the chamber and again enlarged up to the full cross section of the chamber. The hot gas inlets of the chambers are provided in the conically diverging lower ends and the outlets in the upper ends of the chambers, and a gas combustion chamber for producing, supplementing and heating the recirculating hot gases is provided in the hot gas circuits of the preheating, dehydrating and carbonization chambers.

In order to facilitate the temperature adjustment, a supply line for cooled lean gas of the carbonization stage is connected to the outlet of the combustion chamber of the carbonization chamber.

A simple construction of the oven plant is obtained by designing the carbonization chamber as surrounded by its combustion chamber, the combustion chamber thus being accommodated therein, and forming therewith an operating unit.

It is also advisable to provide the dust settling chambers of each circuit immediately adjacent the hot gas outlet of each oven chamber and so that they fit to the double-conical transition zones connecting each oven chamber to the next one.

A plurality of such oven installations may be assembled to a united oven block plant which, in this case, comprises common combustion chambers for the respective oven chambers and a common cooling installation for all ovens.

An object of the invention is to provide an improved method for producing non-abrasive coke forms from brown-coal briquets.

A further object of the invention is to provide such a method in which the coke forms are produced in several stages with the use of hot gas circuits with each stage having a respective separate hot gas recirculating circuit.

For an understanding of the principles of the invention, reference is made to the following description of a typical embodiment thereof as illustrated in the accompanying drawings.

DESCRIPTION OF THE PREFERRED EMBODIMENT

Figure 1:
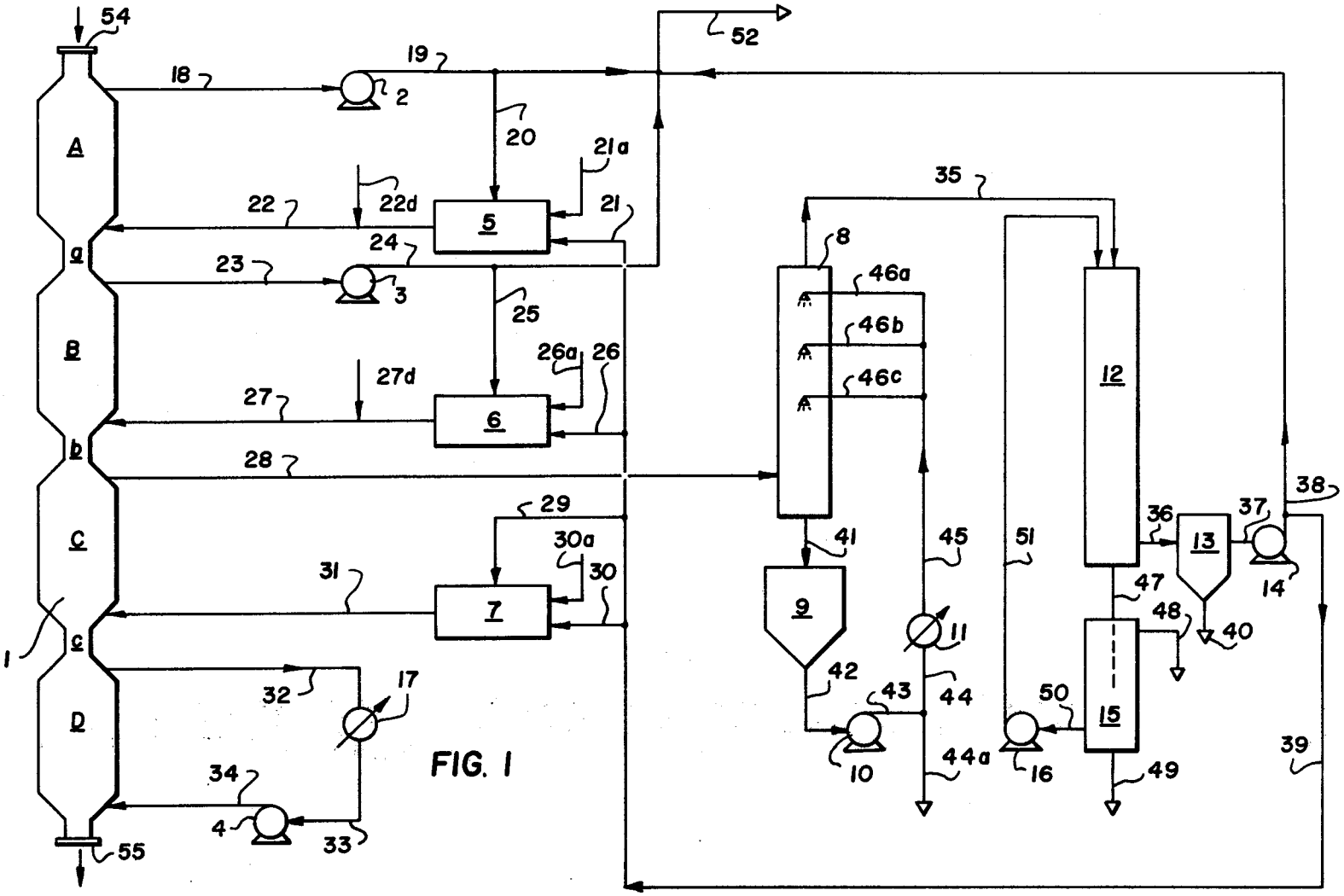
FIG. 1 is a diagrammatical illustration of the method.
Figure 2:
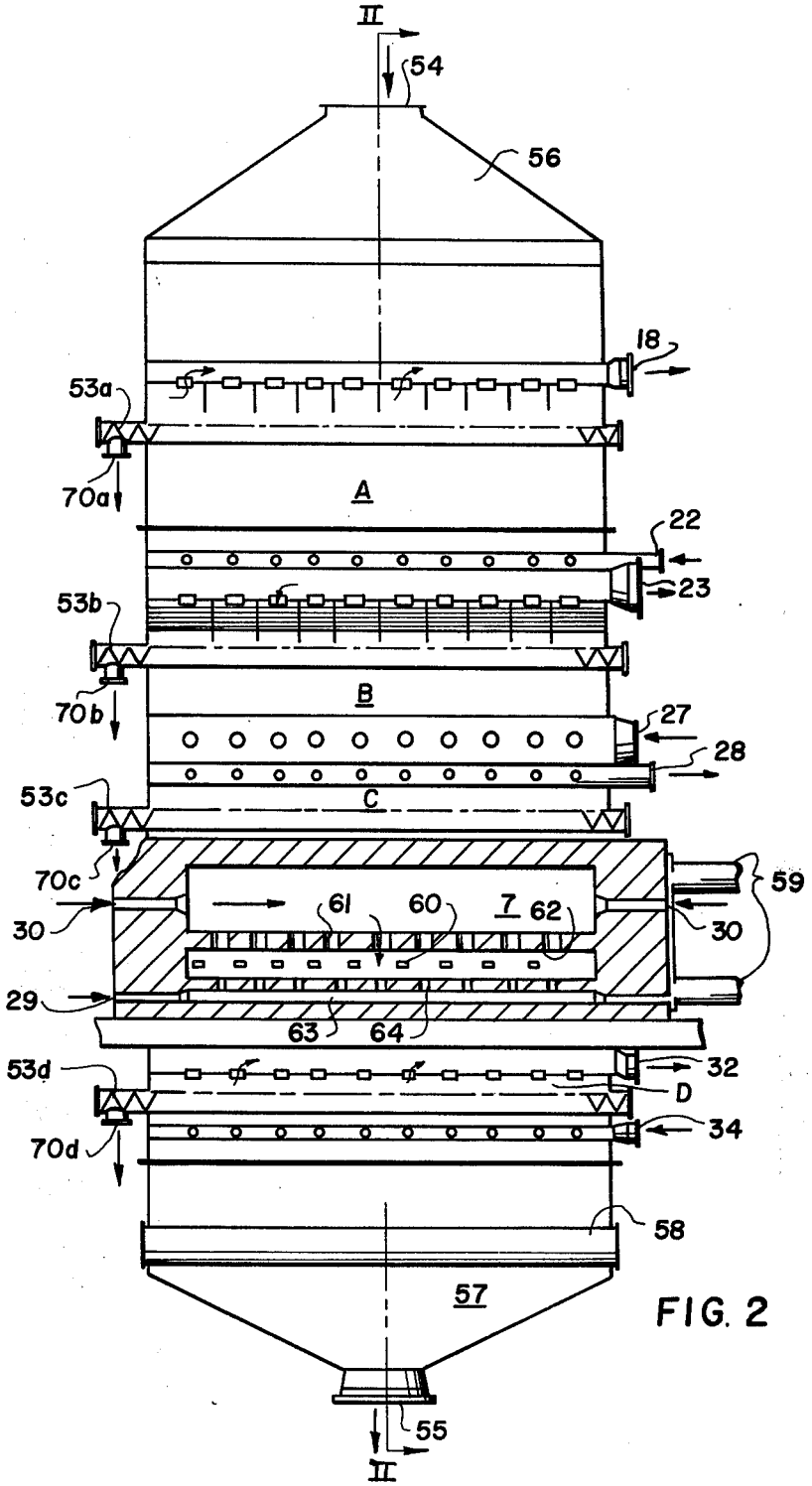
FIG. 2 is partly a lateral elevational view and partly a sectional view of the oven, the sectional view being taken along the line III—III of FIG. 3.
Figure 3:
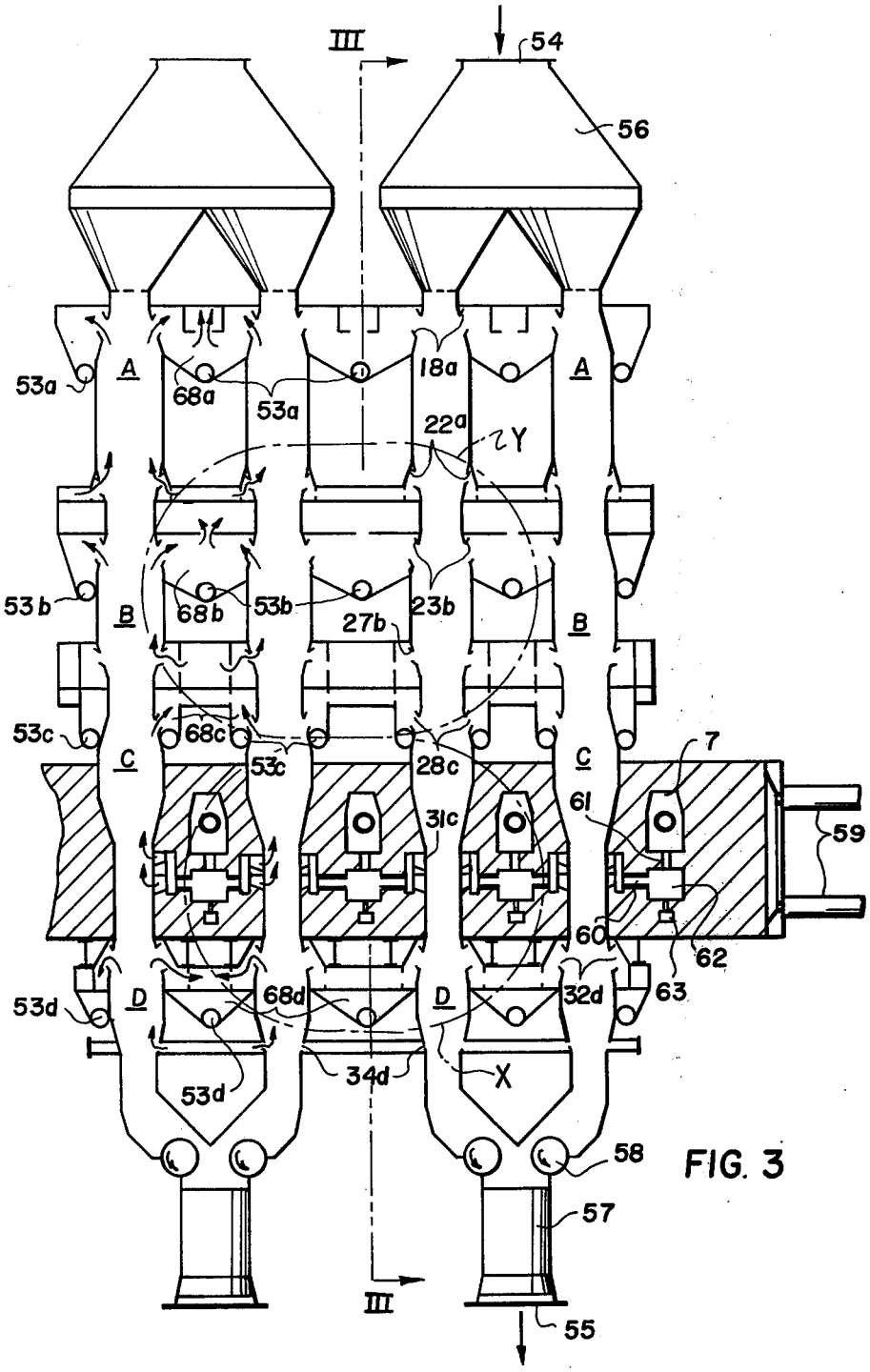
FIG. 3 is a sectional view taken along the line II—II of FIG. 2.

The drawings show a vertical oven block plant 1 comprising a charge lock 54 (not shown in detail), a receiver 56 (FIG. 2), oven chambers A for preheating, B for dehydrating or drying, C for carbonization, and D for cooling, a discharge bin 57, a discharge cylinder 58 and a discharge lock 55 (not shown in detail). The oven chambers are provided with respective gas inlet slots 22*a*, 27*b*, 31*c* and 34*d* which communicate with respective supply lines 22, 27, 31 and 34. The respective gas outlets 18*a*, 23*b*, 28*c* and 32*d* communicate, through respective dust settling chambers 68*a*, 68*b*, 68*c* and 68*d*, with respective outlet lines 18, 23, 28 and 32. The dust collected in dust settling chambers 68*a* to 68*d* is discharged by means of respective screw conveyors 53*a*, 53*b*, 53*c* and 53*d*, through respective locks 70*a*, 70*b*, 70*c* and 70*d*.

The lean gas evacuated through line 28 is directed to a cooling scrubber 8 operating with a tar circuit. To this end, lines 41, 42, 43, 44, 45 and 46*a*, 46*b*, 46*c*, as well as a tar tank 9, a circulating pump 10 and a cooler 11, are provided. Through line 44*a*, the tar in excess is locked out. The cooled and washed gas is directed, through a line 35, to a secondary cooler 12 where the gas is cooled indirectly. The condensed oil components and the ammoniacal water are supplied, through line 47, to a tar separating tank 15. The aqueous phase is discharged through line 49 and the oily phase through line 48. For rinsing the cooler 12, lines 50, 51 and circulating pump 16 are provided.

The scrubbed and cooled lean gas flows through line 36 into an electrostatic filter 13 having a discharge opening 40 and in which the secondary dedusting takes place, and therefrom, through the line 37, to a lean gas blower 14 by which it is forced into lines 38 and 39. Lean gas in excess is evacuated through line 52. The lean gas needed in the plant is distributed, through respective lines 39, 21, 26 and 30, to combustion chambers 5, 6 and 7. The combustion chambers are supplied with combustion air through respective lines 21*a*, 26*a* and 30*a*. Oven chambers A to C are supplied with their circulating gases through respective lines 22, 27 and 31. Connections 22*d* and 27*d* are provided for supplying steam into the circuits which are directed through oven chambers A and B. The circuits are also provided with circulating blowers 2, for oven chamber A, and 3, for oven chamber B. No separate blower is necessary for the circuit of oven chamber C. This circuit is supplied directly, through lines 29 and 39 and by means of blower 14, with cooled lean gas from the scrubber circuit. Cooling chamber D is supplied with flue gases from oven chamber C, circulating in an inert gas circuit. This circuit also comprises lines 32, 33 and 34 as well as a cooler 17 and a blower 4. Oven chambers A to D of the oven plant 1 are connected to each other by the narrowed connecting zones a to c.

The gas circuits of oven chambers A and B communicate, through outlet lines 19 and 24, with exhaust line 52, and they are controlled so that the preheating takes place within the temperature range of 110° C. to 135° C., the dehydration between 210° C. and 230° C., the carbonization between 800° C. and 900° C. and the cooling between 30° C. and 70° C.

While the narrowed zones a to c between the oven chambers do not effect any hermetical separation of the gas circuits relative to each other, the separation thereby obtained is satisfactory.

Efficient removal of dust from the recirculating hot gases is important, and this is effected by a variation of the gas velocities. Thus, inlet slots 22*a*, 27*b*, 31*c*, and 34*d*, through which the recirculating hot gases from lines 22, 27, 31 and 34 pass into oven chambers A to D, have a large passage cross section and are dimensioned so that the gas velocities therethrough are about 1.0 m/sec. The outlet slots 18*a*, 23*b*, 28*c* and 32*d*, through which the gases escape and pass into dust settling chambers 68*a* to 68*d*, are dimensioned similarly. Nozzles 221 and 271, on the contrary, through which the gases, for example, from lines 22 and 27, pass to connecting boxes 222 and 272, have a small passage cross section. Here, the gas velocities are approximately 15 m/sec. The same applies to nozzles 231 through which the gases pass from dust settling chamber 68*b* to line 23.

Figure 5:
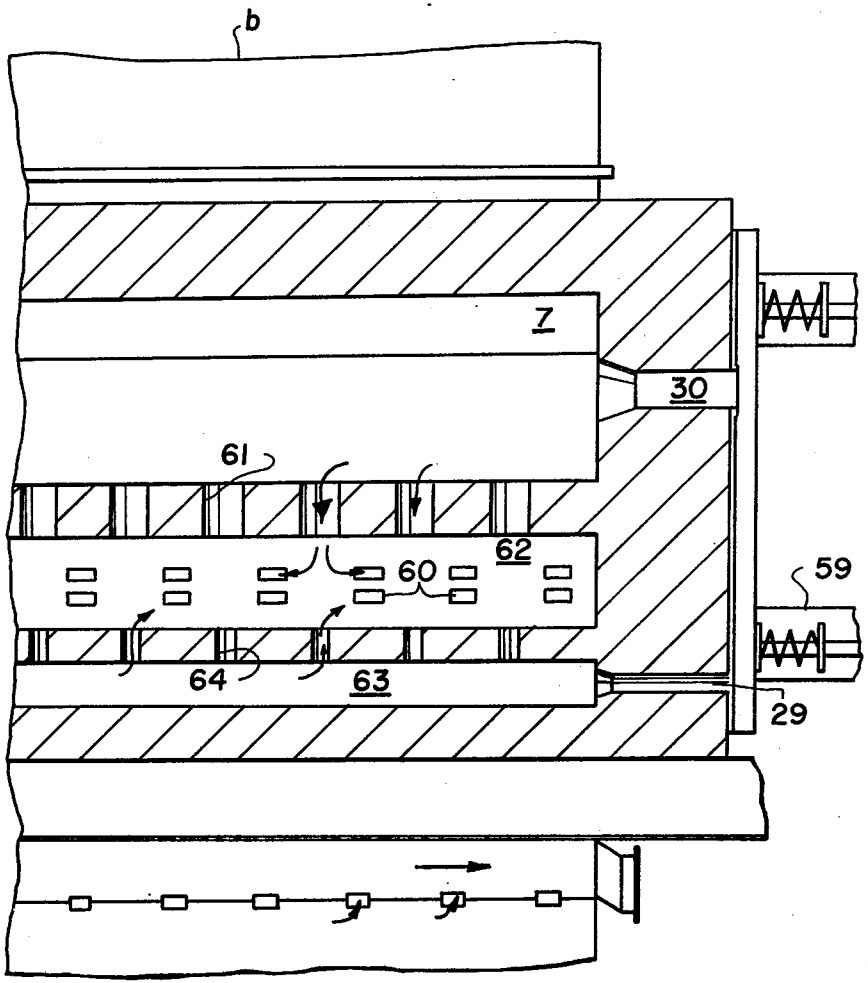
FIG. 5 is a sectional view taken along the line IV—IV of FIG. 4.
Figure 4:
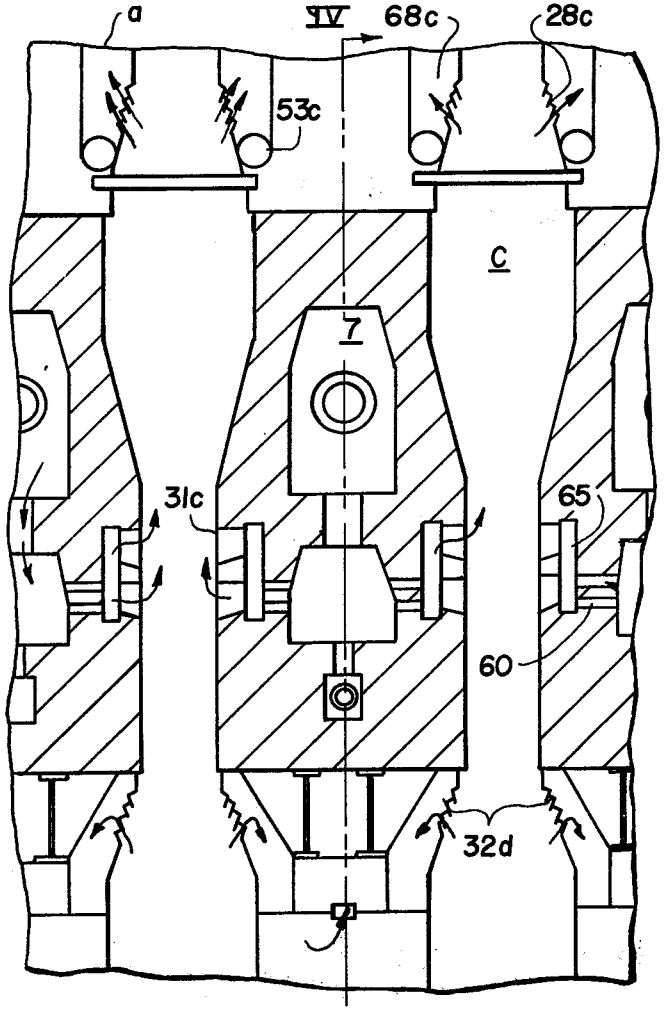
FIG. 4 is the enlarged detail X of FIG. 3.
Figure 6:
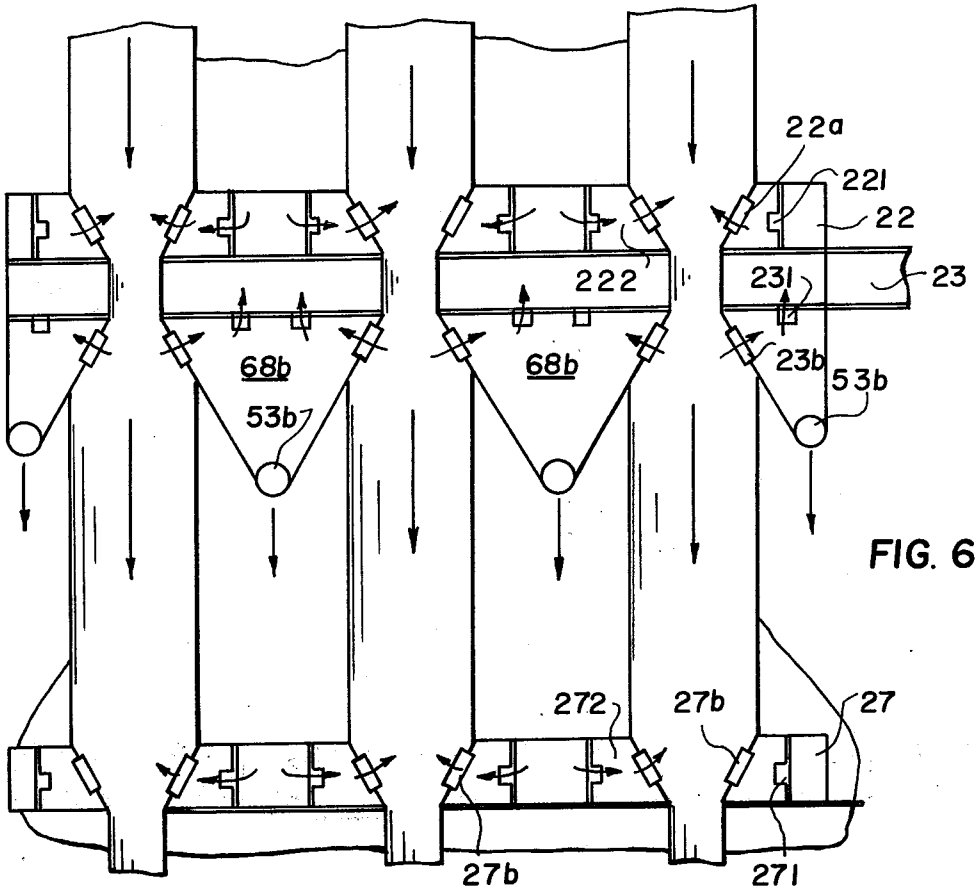
FIG. 6 is the enlarged detail Y of FIG. 3.

In the zone of carbonization chambers C and their combustion chamber 7, passage slots 61 are provided leading from combustion chamber 7 to a mixing channel 62. Cooled lean gas passes through line 29 into channel 63 and through slots 64 into mixing channel 62 (FIG. 5). The mixed gas flows through distributing slots 60 into a collecting channel 65 (FIG. 4) and therefrom, through gas inlets 31*c*, into oven chamber C. Slots 60 also have a small passage cross section causing a gas velocity of approximately 15 m/sec while, in inlets 31*c*, having a large passage cross section, the gas velocities are approximately 1.0 m/sec again. Oven chambers C with combustion chamber 7 and the equipment thereof are anchored at 59.

While a specific embodiment of the invention has been shown and described in detail to illustrate the application of the principles of the invention, it will be understood that the invention may be embodied otherwise without departing from such principles.

The embodiment of the invention in which an exclusive property or privilege is claimed is defined as follows:

1. In a method of producing non-abrasive coke forms of brown-coal briquettes made without a binder from coal having low coking properties in at least three stages in which the brown-coal briquettes, are sequentially, preheated, dehydrated or dried, carbonized and subsequently cooled in recirculating gas circuits in which there is recirculated gas composed substantially of burnt lean gas obtained from said carbonization of the brown-coal briquettes, with the gas recirculated in the circuits of the preheating, dehydrating or drying, and carbonizing stages being heated and the gas recirculated in the circuit of the cooling stage being cooled, the improvement comprising providing, for each of the preheating stage and the dehydrating or drying stage and the carbonization stage, a respective primary gas recirculation circuit which is separate from each other primary gas recirculating circuit and closed except for a respective connection to a source of said lean gas; and separately heating the gas in each of said respective primary gas recirculation circuits of the preheating stage and the dehydrating or drying stage and the carbonization stage.

2. In a method of producing non-abrasive coke forms, as claimed in claim 1, the further improvement comprising providing said cooling stage with a respective primary gas recirculating circuit which is completely closed.

3. In a method of producing non-abrasive coke forms, as claimed in claim 2, including the further improvement comprising, in the carbonization stage, supplementing the hot gas in the respective gas recirculation circuit with cooled lean gas from the carbonization stage before recycling into the carbonization stage.

4. In a method of producing non-abrasive coke forms, as claimed in claim 2, including the further improvement comprising heating and at least partly producing the hot gases recirculating in the preheating, dehydrating and carbonization stages in respective separate combustion chambers.

5. In a method of producing non-abrasive coke forms, as claimed in claim 4, the further improvement comprising including the step of dedusting the hot gases of each stage separately in respective dust settling chambers while reducing their flow velocity to approximately 0.2 to 2.0 m/sec., and collecting the dust.

6. In a method of producing non-abrasive coke forms, as claimed in claim 4, including the further improvement comprising effecting the preheating up to a temperature of 120° C. to 150° C. while using 1.5 to 2.5 $Nm^3/h$ of hot gas per 1 kg of charged brown-coal briquettes; effecting the dehydration at 210° C. to 250° C. while using 5 to 6 $Nm^3/h$ of hot gas per 1 kg of charged brown-coal briquettes; effecting the carbonization at 800° C. to 900° C. while using 1.5 to 2.5 $Nm^3/h$ of hot gas per 1 kg of charged brown-coal briquettes; heating the hot gases in respective combustion chambers up to a temperature of 1000° C. to 1400° C.; and supplementing the hot gases of the carbonization stage with lean gas of the carbonization stage cooled down to a temperature of 25° C. to 35° C.

7. In a method of producing non-abrasive coke forms, as claimed in claim 4, including the further improvement comprising adding steam to the recirculating hot gas of the preheating stage.

8. In a method of producing non-abrasive coke forms, as claimed in claim 4, including the further improvement comprising adding steam to the recirculating hot gas of the drying stage.

9. In a method of producing non-abrasive coke forms, as claimed in claim 4, including the further improvement comprising maintaining the pressure in the primary gas recirculating circuits at a value slightly higher than atmospheric pressure.

* * * * *

UNITED STATES PATENT OFFICE

CERTIFICATE OF CORRECTION

Patent No. 4,134,794 Dated January 16, 1979

Inventor(s) Kurt Lorenz et al.

It is certified that error appears in the above-identified patent and that said Letters Patent are hereby corrected as shown below:

-- Roman Kurtz, Frechen -- should appear as the third inventor on the title page.

Signed and Sealed this

*Fifth* Day of *June 1979*

[SEAL]

*Attest:*

RUTH C. MASON
*Attesting Officer*

DONALD W. BANNER
*Commissioner of Patents and Trademarks*